US006930537B1

(12) United States Patent
Ceekala et al.

(10) Patent No.: US 6,930,537 B1
(45) Date of Patent: Aug. 16, 2005

(54) BAND-GAP REFERENCE CIRCUIT WITH AVERAGED CURRENT MIRROR OFFSETS AND METHOD

(75) Inventors: Vijaya G. Ceekala, Santa Clara, CA (US); James B. Wieser, Pleasanton, CA (US); Devnath Varadarajan, Santa Clara, CA (US); Laurence D. Lewicki, Sunnyvale, CA (US); Jitendra Mohan, Santa Clara, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 592 days.

(21) Appl. No.: 10/061,939

(22) Filed: Feb. 1, 2002

(51) Int. Cl.[7] ..... G05F 1/10; G05F 3/02
(52) U.S. Cl. ..... 327/539
(58) Field of Search ..... 327/539; 323/313

(56) References Cited

U.S. PATENT DOCUMENTS 5,867,012 A * 2/1999 Tuthill ..... 323/313
6,060,874 A * 5/2000 Doorenbos ..... 323/316
6,201,379 B1 * 3/2001 MacQuigg et al. ..... 323/313
6,507,179 B1 * 1/2003 Jun et al. ..... 323/313
6,535,054 B1 * 3/2003 Ceekala et al. ..... 327/539

* cited by examiner

*Primary Examiner*—Quan Tra

(57) ABSTRACT

A band-gap reference circuit with averaged current mirror offsets is provided that includes a differential amplifier circuit, a low current transistor circuit, a high current transistor circuit, and a configuration circuit. The differential amplifier circuit includes a first input node operable to receive a first input signal, a second input node operable to receive a second input signal, and an output node operable to generate an output signal based on the input signal difference. The low current transistor circuit is coupled to the differential amplifier circuit and is operable to receive the output signal and to generate the first input signal based on the output signal. The high current transistor circuit is coupled to the differential amplifier circuit and is operable to receive the output signal and to generate the second input signal based on the output signal. The configuration circuit is coupled to the low current transistor circuit and to the high current transistor circuit. The configuration circuit is operable to configure the band-gap reference circuit for a plurality of states by switching a plurality of components between the low current transistor circuit and the high current transistor circuit at specified intervals.

20 Claims, 5 Drawing Sheets

BAND-GAP REFERENCE CIRCUIT WITH AVERAGED CURRENT MIRROR OFFSETS AND METHOD

TECHNICAL FIELD OF THE INVENTION

The present invention relates generally to reference voltage circuits and, more particularly, to a band-gap reference circuit with averaged current mirror offsets and method.

BACKGROUND OF THE INVENTION

The rapid proliferation of local area network (LANs) in the corporate environment and the increased demand for time-sensitive delivery of messages and data between users has spurred development of high-speed (gigabit) Ethernet LANs. The 100BASE-TX Ethernet LANs using category-5 (CAT-5) copper wire and the 1000BASE-T Ethernet LANs capable of one gigabit per second (1 Gbps) data rates over CAT-5 data grade wire use new techniques for the transfer of high-speed data symbols.

Conventional 1000BASE-T Ethernet LAN drivers, in addition to nearly all other signal processing/communication chips and systems, use band-gap reference circuits. These band-gap reference circuits are able to generate relatively constant reference voltages that have a well-defined magnitude, as well as minimal process variation, temperature variation, and voltage variation.

However, conventional CMOS-based band-gap reference circuits are highly prone to variations as a result of random mismatches of the MOS transistors. These mismatches are often manifested as current mismatches and, in the case of operational amplifiers, as offset voltages.

SUMMARY OF THE INVENTION

In accordance with the present invention, a band-gap reference circuit with averaged current mirror offsets and method are provided that substantially eliminate or reduce disadvantages and problems associated with conventional systems and methods. In particular, current mirror components of the band-gap reference circuit are switched at specified intervals to average out any offsets due to process variation in the components.

According to one embodiment of the present invention, a band-gap reference circuit with averaged current mirror offsets is provided that includes a differential amplifier circuit, a low current transistor circuit, a high current transistor circuit, and a configuration circuit. The differential amplifier circuit includes a first input node operable to receive a first input signal, a second input node operable to receive a second input signal, and an output node operable to generate an output signal based on the input signal difference. The configuration circuit is operable to configure the band-gap reference circuit for a plurality of states by switching a plurality of components between the low current transistor circuit and the high current transistor circuit at specified intervals.

According to another embodiment of the present invention, a method for averaging current mirror offsets in a band-gap reference circuit is provided that includes configuring the band-gap reference circuit for a first state based on a first trigger and waiting for a second trigger. The band-gap reference circuit is then configured for a second state based on the second trigger.

Technical advantages of one or more embodiments of the present invention include providing an improved band-gap reference circuit. In a particular embodiment, current mirror components of the band-gap reference circuit are switched at specified intervals. As a result, offsets for the band-gap reference circuit due to process variation in the current mirrors are averaged out. Accordingly, a more stable reference voltage is provided by the band-gap reference circuit.

Other technical advantages will be readily apparent to one skilled in the art from the following figures, description, and claims.

Before undertaking the DETAILED DESCRIPTION OF THE INVENTION, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present invention and its advantages, reference is now made to the following description taken in conjunction with the accompanying drawings, wherein like reference numerals represent like parts, in which.

DETAILED DESCRIPTION OF THE INVENTION

FIGS. 1 through 4, discussed below, and the various embodiments used to describe the principles of the present invention in this patent document are by way of illustration only and should not be construed in any way to limit the scope of the invention. Those skilled in the art will understand that the principles of the present invention may be implemented in any suitably arranged band-gap reference circuit.

Figure 1:
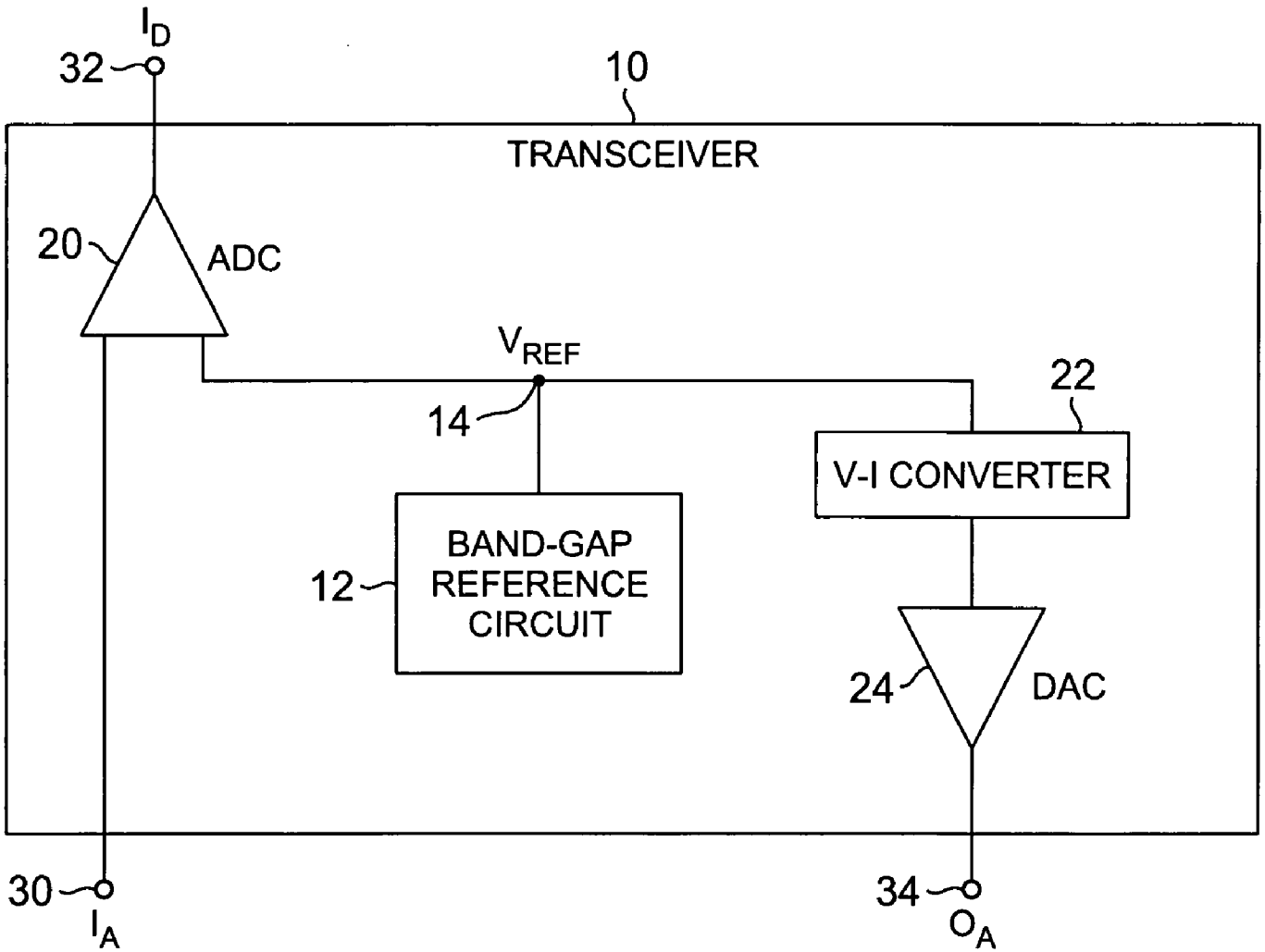
FIG. 1 is a block diagram illustrating a transceiver including a band-gap reference circuit with averaged current mirror offsets in accordance with one embodiment of the present invention.

FIG. 1 is a block diagram illustrating a transceiver 10 in accordance with one embodiment of the present invention. According to one embodiment, the transceiver 10 comprises a gigabit Ethernet transceiver. However, it will be understood that the transceiver 10 may comprise any suitable transceiver operable to receive and transmit data.

The transceiver 10 comprises a band-gap reference circuit 12 that is operable to generate a reference voltage 14 for the transceiver 10. As described in more detail below, the band-gap reference circuit 12 is operable to cycle between different states by switching current mirror components at specified intervals in order to provide offset cancellation, which minimizes offset voltages and current mismatches that may result from process, voltage, and temperature variations.

The transceiver 10 also comprises an analog-to-digital converter (ADC) 20, a voltage-to-current (V-I) converter 22, and a digital-to-analog converter (DAC) 24, in addition to any other suitable circuitry. The ADC 20, which is coupled to the band-gap reference circuit 12, is operable to receive an analog input signal ($I_A$) 30 and the reference voltage 14 and to generate a digital input signal ($I_D$) 32 based on the analog input signal 30 and the reference voltage 14.

The V-I converter 22, which is also coupled to the band-gap reference circuit 12, is operable to receive the reference voltage 14 and to convert the reference voltage 14 into a specified current based on the reference voltage 14. The DAC 24 is coupled to the V-I converter 22 and is operable to transmit an analog output signal ($O_A$) 34 based on the specified current from the V-I converter 22.

In operation, the band-gap reference circuit 12 of the transceiver 10 cycles between a plurality of states at specified intervals. According to one embodiment, the band-gap reference circuit 12 cycles between four states, with the band-gap reference circuit 12 in each state for approximately 25% of each cycle. Thus, for this embodiment, the band-gap reference circuit 12 may be in a first state for approximately the first 25% of the cycle, in a second state for approximately the second 25% of the cycle, in a third state for approximately the third 25% of the cycle, and in a fourth state for approximately the last 25% of the cycle. However, it will be understood that the states may be otherwise allocated within the cycle without departing from the scope of the present invention. In addition, it will be understood that the band-gap reference circuit 12 may cycle between any suitable number of states without departing from the scope of the present invention.

The band-gap reference circuit 12 generates the reference voltage 14 and provides the reference voltage 14 to both the ADC 20 and the V-I converter 22. The ADC 20 may also receive an analog input signal 30 and may convert that signal 30 into a digital input signal 32 based on the reference voltage 14. The V-I converter 22 converts the reference voltage 14 into a specified current and provides the specified current to the DAC 24. The DAC 24 may generate an analog output signal 34 based on the specified current and transmit the analog output signal 34 from the transceiver 10 to any other suitable component.

Figure 2:
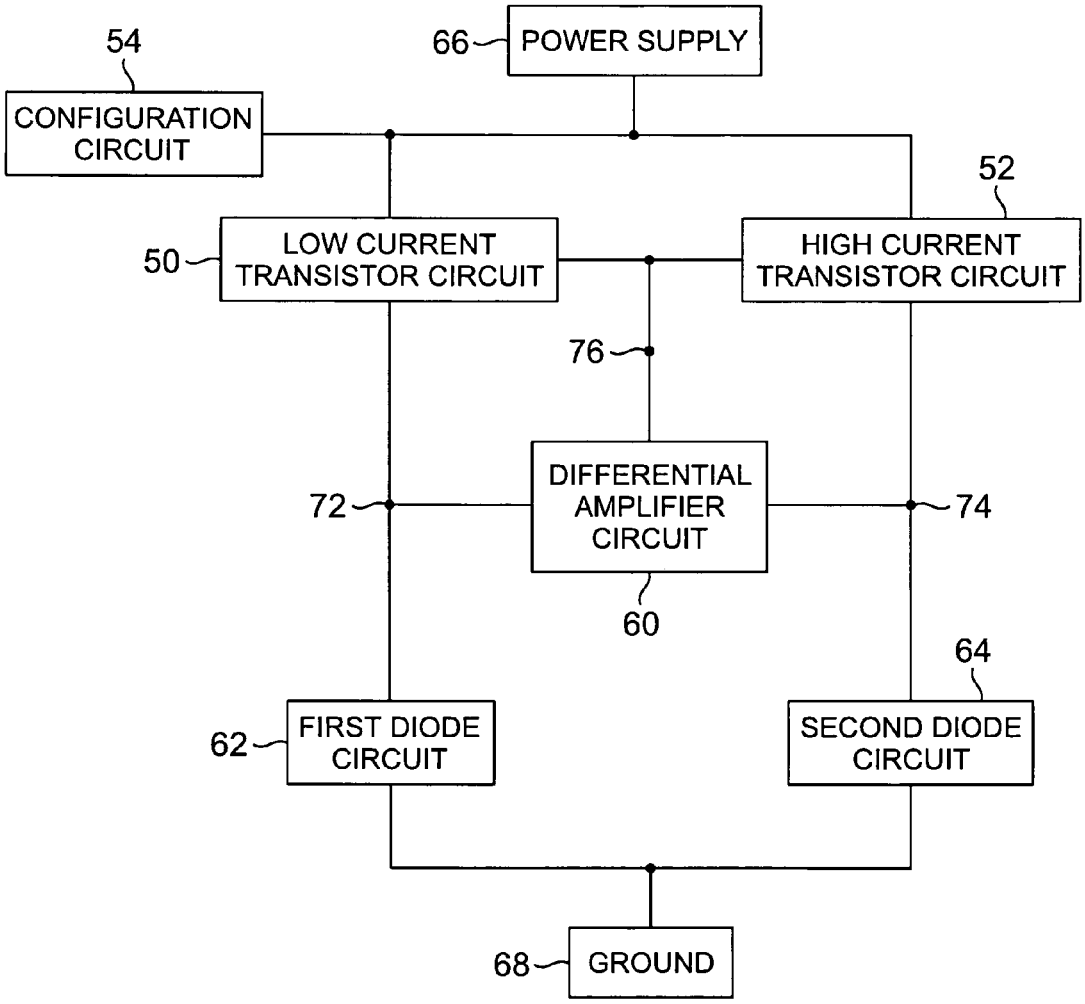
FIG. 2 is a block diagram illustrating the band-gap reference circuit of FIG. 1 in accordance with one embodiment of the present invention.

FIG. 2 is a block diagram illustrating the band-gap reference circuit 12 in accordance with one embodiment of the present invention. It will be understood that, in addition to being included in a transceiver 10, the band-gap reference circuit 12 may be included in any other suitable circuit with a use for a relatively constant reference voltage 14 without departing from the scope of the present invention.

The band-gap reference circuit 12 comprises a low current transistor 50, a high current transistor 52, and a configuration circuit 54 operable to configure the band-gap reference circuit 12 for a plurality of states by switching components between the low current transistor 50 and the high current transistor 52, as described in more detail below.

The band-gap reference circuit 12 also comprises a differential amplifier circuit 60, a first diode circuit 62, a second diode circuit 64, a power supply 66, and a ground 68. The differential amplifier circuit 60 is coupled to the low and high current transistors 50 and 52, in addition to the first and second diode circuits 62 and 64.

The differential amplifier circuit 60 is operable to receive a first input signal at a first input node 72 and to receive a second input signal at a second input node 74. The differential amplifier circuit 60 is also operable to generate an output signal at an output node 76 based on the input signal difference.

The low current transistor circuit 50 is coupled to the differential amplifier circuit 60, to the first diode circuit 62, and to the power supply 66. The low current transistor circuit 50 is operable to receive the output signal from the differential amplifier circuit 60 and to generate the first input signal based on the output signal.

The high current transistor circuit 52 is coupled to the differential amplifier circuit 60, to the second diode circuit 64, and to the power supply 66. The high current transistor circuit 52 is operable to receive the output signal from the differential amplifier circuit 60 and to generate the second input signal based on the output signal.

The configuration circuit 54 is coupled to the low current transistor circuit 50 and to the high current transistor circuit 52. The configuration circuit 54 is operable to generate triggers that are operable to configure the band-gap reference circuit 12 for any one of the different states.

For example, according to one embodiment, the configuration circuit 54 comprises a digital counter that is operable to generate triggers in the form of timing pulses. For this embodiment, the configuration circuit 54 is operable to configure the band-gap reference circuit 12 for any one of the different states based on the timing pulses. However, it will be understood that the configuration circuit 54 may be operable to configure the band-gap reference circuit 12 for any one of the different states in any other suitable manner without departing from the scope of the present invention.

In accordance with one embodiment, the band-gap reference circuit 12 comprises a plurality of switches that are operable to either open or close the circuit in accordance with a signal from the configuration circuit 54 that is produced based on the triggers. The opening and closing of the switches results in the band-gap reference circuit 12 being configured for a particular state. According to the embodiment in which the configuration circuit 54 comprises a digital counter, the switches are operable to function in accordance with a signal from the configuration circuit 54 that is produced based on the timing pulses generated by the digital counter.

The power supply 66 is coupled to the low current transistor circuit 50 and to the high current transistor circuit 52. The power supply 66 is operable to provide a specified voltage and/or current to the low and high current transistor circuits 50 and 52. According to one embodiment, the power supply 66 is operable to provide about 3.3 volts. However, it will be understood that the power supply 66 may be operable to provide any suitable voltage without departing from the scope of the present invention.

In operation, the band-gap reference circuit 12 cycles between a specified number of states based on signals from the configuration circuit 54. Initially, the configuration circuit 54 may configure the band-gap reference circuit 12 for a first state. While in the first state, the low and high current transistor circuits 50 and 52 receive an output signal from the differential amplifier circuit 60. In conjunction with the diode circuits 62 and 64, the low and high current transistor circuits 50 and 52 generate a first input signal and a second input signal, respectively, based on the output signal.

The differential amplifier circuit 60 receives the first input signal from the low current transistor circuit 50 at the first input node 72 and the second input signal from the high current transistor circuit 52 at the second input node 74. The differential amplifier circuit 60 then generates the output signal based on the input signal difference. The reference voltage provided by the band-gap reference circuit 12 is generated by the high current transistor circuit 52 in conjunction with the second diode circuit 64.

After the specified interval for the first state has passed, the configuration circuit 54 may re-configure the band-gap reference circuit 12 for a second state. The process for generating the reference voltage described above then continues with the band-gap reference circuit 12 in the second state, after which the configuration circuit 54 re-configures the band-gap reference circuit 12 for any suitable number of states before returning the band-gap reference circuit 12 to the first state.

In this way, a different offset may affect the reference voltage provided by the band-gap reference circuit 12 in each different state, with the offsets typically being both positive and negative. Thus, by cycling the band-gap reference circuit 12 between the different states, the current offsets due to process variation are averaged out, resulting in a more stable reference voltage.

Figure 3A:
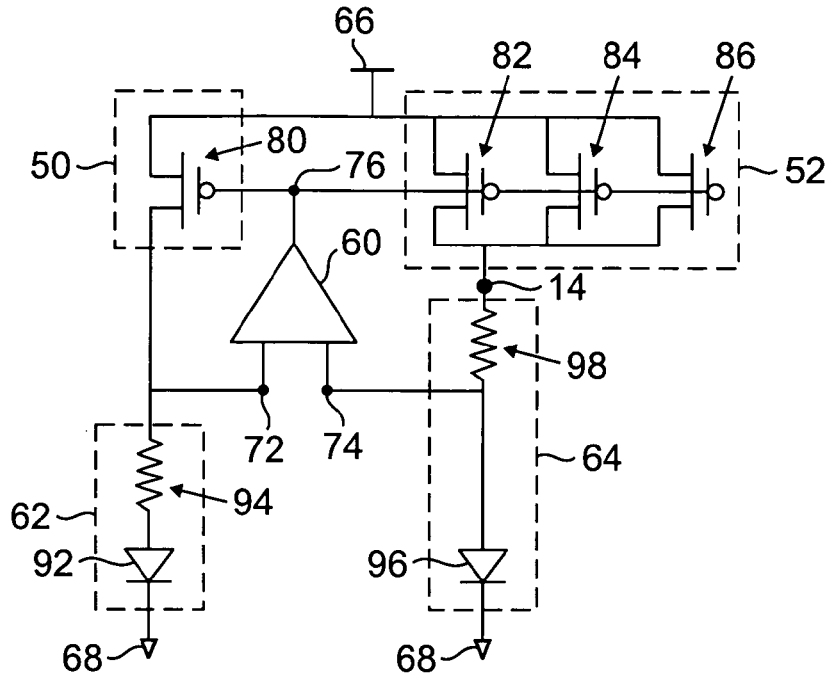
FIGS. 3A–D are circuit diagrams illustrating the band-gap reference circuit of FIG. 2 in accordance with one embodiment of the present invention.
Figure 3B:
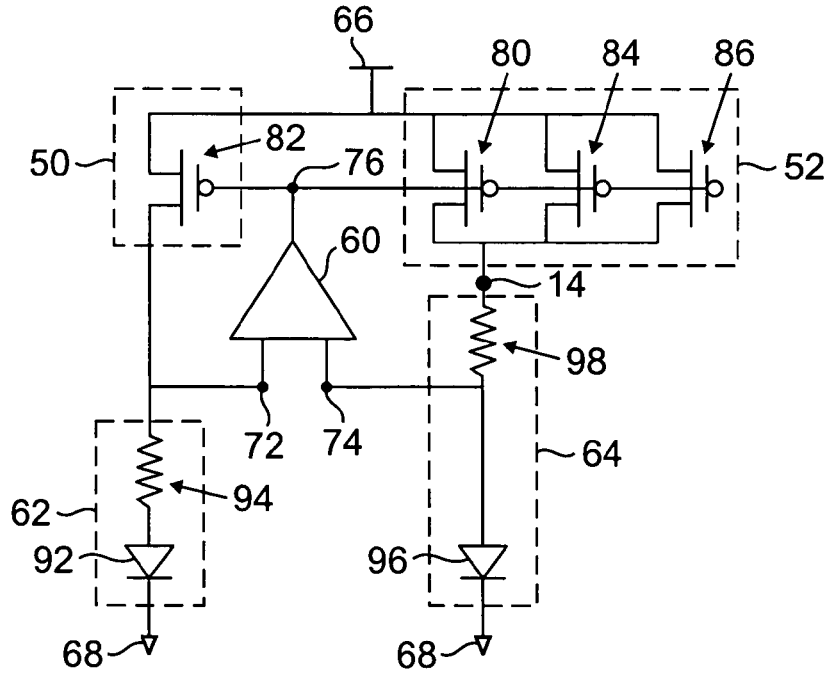
Figure 3C:
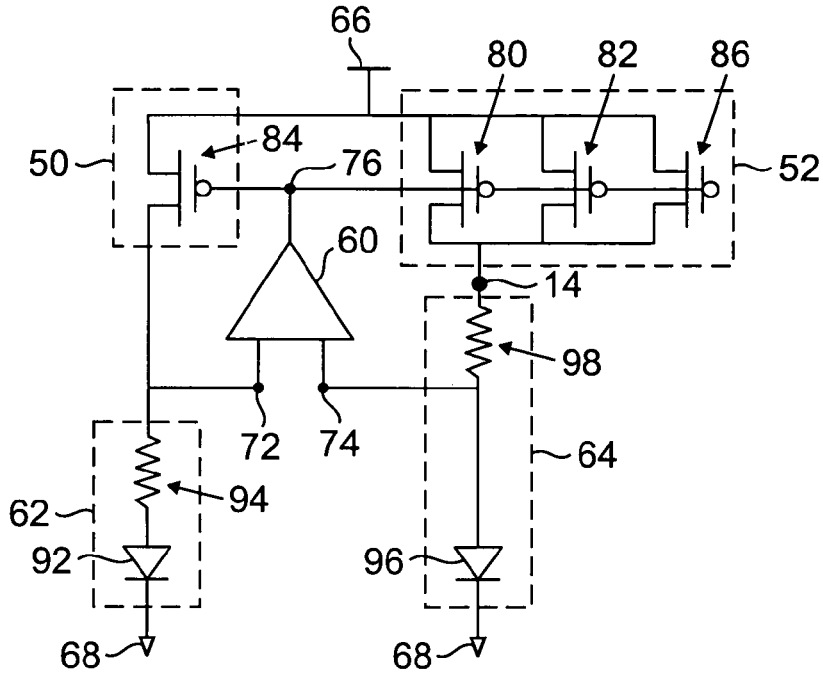
Figure 3D:
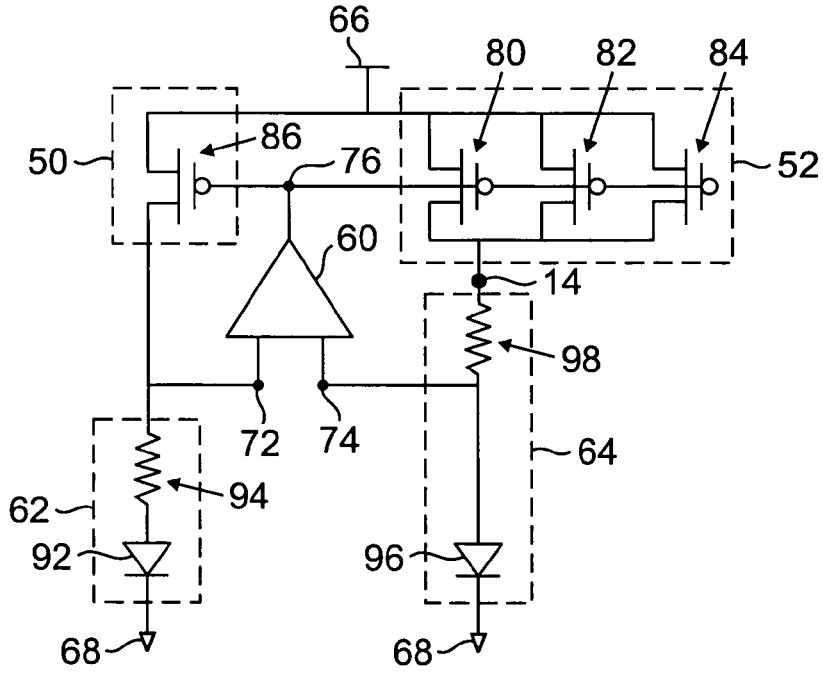

FIGS. 3A–D are circuit diagrams illustrating the band-gap reference circuit 12 in accordance with one embodiment of the present invention. According to this embodiment, the band-gap reference circuit 12 is operable to be configured into four different states. FIG. 3A illustrates the band-gap reference circuit 12 in a first state, FIG. 3B illustrates the band-gap reference circuit 12 in a second state, FIG. 3C illustrates the band-gap reference circuit 12 in a third state, and FIG. 3D illustrates the band-gap reference circuit 12 in a fourth state.

It will be understood that the configurations illustrated in FIGS. 3A–D may otherwise correspond to the four states. For example, FIGS. 3A–D may illustrate the band-gap reference circuit 12 in the third state, the second state, the fourth state, and the first state, respectively, without departing from the scope of the present invention.

According to the illustrated embodiment, the power supply 66 comprises a voltage source. The power supply 66 may be operable to provide about 3.3 volts or any other suitable amount of voltage to the band-gap reference circuit 12.

The differential amplifier circuit 60 in the illustrated embodiment comprises a CMOS Miller operational transconductance amplifier. However, it will be understood that the differential amplifier circuit 60 may comprise a series of high-gain folded cascode stages or any other suitable differential amplifier circuit operable to receive two inputs and generate an output based on the input difference.

According to one embodiment, the low current circuit 50 comprises a single PMOS transistor and the high current circuit 52 comprises three PMOS transistors. However, it will be understood that these circuits 50 and 52 may each comprise any suitable number of any suitable type of transistors without departing from the scope of the present invention. According to the described embodiment, the PMOS transistors are each approximately the same size.

As described in more detail below, the PMOS transistors 80, 82, 84 and 86 are switched between the low and high current circuits 50 and 52 in order to vary the offsets affecting the reference voltage, resulting in the offsets averaging each other out to provide a more stable reference voltage at the reference voltage node 14.

The sources of the PMOS transistors 80, 82, 84 and 86 are coupled to the power supply 66. Based on the circuit 50 or 52 into which the PMOS transistors 80, 82, 84 and 86 have been switched for the current state of the band-gap reference circuit 12, the drain of one of the PMOS transistors 80, 82, 84 or 86 is coupled to the first diode circuit 62, and the drain of the remaining three PMOS transistors 80, 82, 84 and 86 is coupled to the second diode circuit 64.

The current through the low current transistor circuit 50 comprises about I, and the current through the high current transistor circuit 52 comprises about N*I. Thus, N comprises the current ratio for the band-gap reference circuit 12. Because each PMOS transistor 80, 82, 84 and 86 is approximately the same size, the current ratio, N, for the illustrated band-gap reference circuit 12 comprises about three.

The first diode circuit 62 comprises a diode 92 and a resistor 94. According to one embodiment, the diode 92 comprises a vertical pnp transistor with its base and collector coupled to ground 68 and its emitter coupled to the resistor 94. The resistor 94 is coupled to the drain of the PMOS transistor in the low current transistor circuit 50.

The second diode circuit 64 comprises a diode 96 and a resistor 98. According to one embodiment, the diode 96 comprises a vertical pnp transistor with its base and collector coupled to ground 68 and its emitter coupled to the resistor 98. The resistor 98 is coupled to the drains of the PMOS transistors in the high current transistor circuit 52.

According to one embodiment, resistors 94 and 98 each provide approximately 10 kΩ of resistance. However, it will be understood that resistors 94 and 98 may provide any suitable amount of resistance without departing from the scope of the present invention.

In operation, when the band-gap reference circuit 12 is configured for the first state, the low current circuit 50 comprises PMOS transistor 80, and the high current circuit 52 comprises PMOS transistors 82, 84 and 86. Thus, for the specified interval of the cycle corresponding to the first state, the band-gap reference circuit 12 may be illustrated as shown in FIG. 3A.

When the band-gap reference circuit 12 is configured for the second state, the low current circuit 50 comprises PMOS transistor 82, and the high current circuit 52 comprises PMOS transistors 80, 84 and 86. Thus, for the specified interval of the cycle corresponding to the second state, the band-gap reference circuit 12 may be illustrated as shown in FIG. 3B.

When the band-gap reference circuit 12 is configured for the third state, the low current circuit 50 comprises PMOS transistor 84, and the high current circuit 52 comprises PMOS transistors 80, 82 and 86. Thus, for the specified interval of the cycle corresponding to the third state, the band-gap reference circuit 12 may be illustrated as shown in FIG. 3C.

When the band-gap reference circuit 12 is configured for the fourth state, the low current circuit 50 comprises PMOS transistor 86, and the high current circuit 52 comprises PMOS transistors 80, 82 and 84. Thus, for the specified interval of the cycle corresponding to the fourth state, the band-gap reference circuit 12 may be illustrated as shown in FIG. 3D.

In general, the offsets for the four states may result in the reference voltage being either above or below the target reference voltage for each state. Thus, these positive and negative offsets are averaged out. In this way, variation in the reference voltage due to the input referred offsets for the differential amplifier circuit 60 is drastically reduced.

Figure 4:
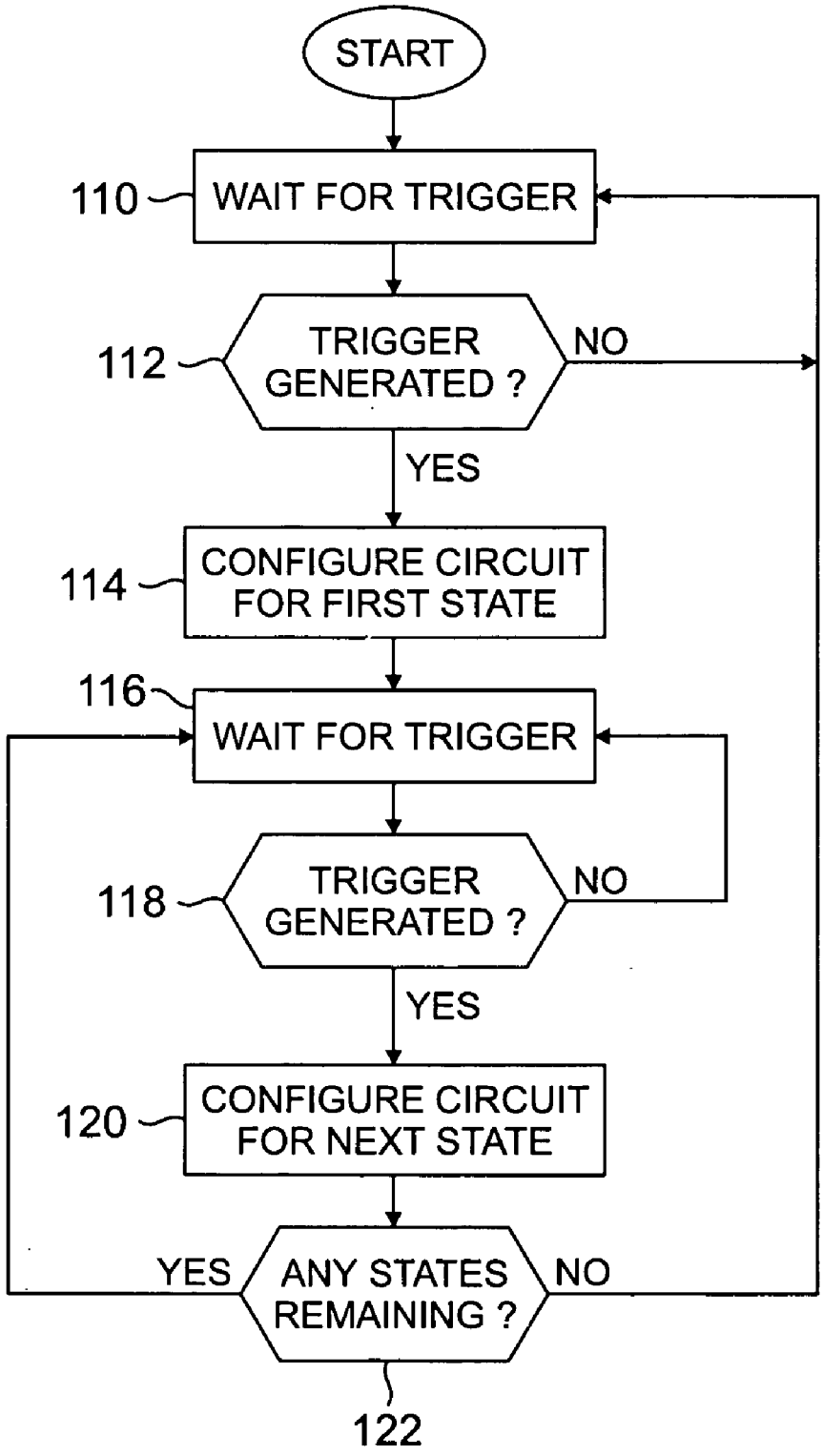
FIG. 4 is a flow diagram illustrating a method for averaging out the current mirror offsets in the band-gap reference circuit of FIG. 3 in accordance with one embodiment of the present invention.

FIG. 4 is a flow diagram illustrating a method for averaging out the current mirror offsets in the band-gap reference circuit 12 in accordance with one embodiment of the present invention. The method begins at step 110 where the configuration circuit 54 waits for a trigger.

At decisional step 112, the configuration circuit 54 determines whether or not a trigger has been generated. If the configuration circuit 54 determines that a trigger has not been generated, the method follows the No branch from decisional step 112 and returns to step 110 to wait for the trigger.

However, if the configuration circuit 54 determines that a trigger has been generated, the method follows the Yes branch from decisional step 112 to step 114. At step 114, the configuration circuit 54 configures the band-gap reference circuit 12 for the first state. According to one embodiment, the band-gap reference circuit 12 is configured as illustrated in FIG. 3A.

At step 116, the configuration circuit 54 waits for another trigger. At decisional step 118, the configuration circuit 54 determines whether or not a trigger has been generated. If the configuration circuit 54 determines that a trigger has not been generated, the method follows the No branch from decisional step 118 and returns to step 116 to wait for the trigger.

However, if the configuration circuit 54 determines that a trigger has been generated, the method follows the Yes branch from decisional step 118 to step 120. At step 120, the configuration circuit 54 configures the band-gap reference circuit 12 for the next state. According to one embodiment, the band-gap reference circuit 12 is configured as illustrated in FIG. 3B.

At decisional step 122, a determination is made regarding whether or not any states are remaining for the current cycle of the band-gap reference circuit 12. If no states are remaining, the method follows the No branch from decisional step 122 and returns to step 110 in order to wait for a trigger to re-configure the band-gap reference circuit 12 for the first state.

However, if additional states are remaining, the method follows the Yes branch from decisional step 122 and returns to step 116 in order to wait for a trigger to re-configure the band-gap reference circuit 12 for another state. According to one embodiment, after being configured as illustrated in FIG. 3B, the band-gap reference circuit 12 is re-configured as illustrated in FIG. 3C and as illustrated in FIG. 3D before returning to the first state as illustrated in FIG. 3A.

In this way, components of the low and high current transistor circuits 50 and 52 may be switched at specified intervals. Therefore, offsets for the band-gap reference circuit 12 due to process variation in those components are averaged out, resulting in the band-gap reference circuit 12 providing a more stable reference voltage.

Although the present invention has been described with several embodiments, various changes and modifications may be suggested to one skilled in the art. It is intended that the present invention encompass such changes and modifications as fall within the scope of the appended claims.

What is claimed is:

1. A band-gap reference circuit with averaged current mirror offsets, comprising:

a differential amplifier circuit comprising a first input node operable to receive a first input signal, a second input node operable to receive a second input signal, and an output node operable to generate an output signal based on the input signal difference;

a low current transistor circuit coupled to the differential amplifier circuit and operable to receive the output signal and to generate the first input signal based on the output signal;

a high current transistor circuit coupled to the differential amplifier circuit and operable to receive the output signal and to generate the second input signal based on the output signal; and a configuration circuit coupled to the low current transistor circuit and to the high current transistor circuit, the configuration circuit operable to configure the band-gap reference circuit for a plurality of states by switching a plurality of components between the low current transistor circuit and the high current transistor circuit at specified intervals.

2. The band-gap reference circuit of claim 1, the plurality of components comprising at least three PMOS transistors.

3. The band-gap reference circuit of claim 1, the plurality of components comprising at least four PMOS transistors.

4. The band-gap reference circuit of claim 2, the configuration circuit operable to configure the band-gap reference circuit for a plurality of states by switching the PMOS transistors between the low current transistor circuit and the high current transistor circuit such that the low current transistor circuit comprises a single PMOS transistor and the high current transistor circuit comprises the remaining PMOS transistors.

5. The band-gap reference circuit of claim 1, further comprising:

a first diode circuit coupled to the differential amplifier circuit and to the low current transistor circuit; and a second diode circuit coupled to the differential amplifier circuit and to the high current transistor circuit.

6. The band-gap reference circuit of claim 5, the low current transistor circuit comprising a single PMOS transistor having a source coupled to a power supply and a drain coupled to the first diode circuit, and the high current transistor circuit comprising at least three PMOS transistors, each having a source coupled to the power supply, a drain coupled to the second diode circuit, and a gate coupled to a gate for the single PMOS transistor of the low current transistor circuit.

7. The band-gap reference circuit of claim 6, the first diode circuit comprising a first diode and a first resistor, the first resistor coupled to the drain of the single PMOS transistor of the low current transistor circuit and to the first diode, and the second diode circuit comprising a second diode and a second resistor, the second resistor coupled to the drains of the PMOS transistors of the high current transistor circuit and to the second diode.

8. A transceiver, comprising:

a digital-to-analog converter operable to receive a digital output signal and to generate an analog output signal based on the digital output signal;

a voltage-to-current converter coupled to the digital-to-analog converter, the voltage-to-current converter operable to receive a reference voltage, to generate a specified current based on the reference voltage, and to provide the specified current to the digital-to-analog converter;

a band-gap reference circuit coupled to the voltage-to-current converter, the band-gap reference circuit operable to generate the reference voltage and to provide the reference voltage to the voltage-to-current converter;

an analog-to-digital converter coupled to the band-gap reference circuit, the analog-to-digital converter operable to receive an analog input signal and the reference voltage and to generate a digital input signal based on the analog input signal and the reference voltage; and the band-gap reference circuit comprising a differential amplifier circuit comprising a first input node operable to receive a first input signal, a second input node operable to receive a second input signal, and an output node operable to generate an output signal based on the input signal difference, a low current transistor circuit coupled to the differential amplifier circuit and operable to receive the output signal and to generate the first input signal based on the output signal, a high current transistor circuit coupled to the differential amplifier circuit and operable to receive the output signal and to generate the second input signal based on the output signal, and a configuration circuit coupled to the low current transistor circuit and to the high current transistor circuit, the configuration circuit operable to configure the band-gap reference circuit for a plurality of states by switching a plurality of components between the low current transistor circuit and the high current transistor circuit at specified intervals.

9. The transceiver of claim 8, the plurality of components comprising at least three PMOS transistors.

10. The transceiver of claim 8, the plurality of components comprising at least four PMOS transistors.

11. The transceiver of claim 10, the configuration circuit operable to configure the band-gap reference circuit for a plurality of states by switching the PMOS transistors between the low current transistor circuit and the high current transistor circuit such that the low current transistor circuit comprises a single PMOS transistor and the high current transistor circuit comprises the remaining PMOS transistors.

12. The transceiver of claim 8, the band-gap reference circuit further comprising:

a first diode circuit coupled to the differential amplifier circuit and to the low current transistor circuit; and a second diode circuit coupled to the differential amplifier circuit and to the high current transistor circuit.

13. The transceiver of claim 12, the low current transistor circuit comprising a single PMOS transistor having a source coupled to a power supply and a drain coupled to the first diode circuit, and the high current transistor circuit comprising at least three PMOS transistors, each having a source coupled to the power supply, a drain coupled to the second diode circuit, and a gate coupled to a gate for the single PMOS transistor of the low current transistor circuit.

14. The transceiver of claim 13, the first diode circuit comprising a first diode and a first resistor, the first resistor coupled to the drain of the single PMOS transistor of the low current transistor circuit and to the first diode, and the second diode circuit comprising a second diode and a second resistor, the second resistor coupled to the drains of the PMOS transistors of the high current transistor circuit and to the second diode.

15. A method for averaging current mirror offsets in a band-gap reference circuit, comprising:

configuring the band-gap reference circuit for a first state based on a first trigger;

waiting for a second trigger;

configuring the band-gap reference circuit for a second state based on the second trigger;

waiting for a third trigger; and configuring the band-gap reference circuit for a third state based on the third trigger.

16. The method of claim 15, configuring the band-gap reference circuit comprising switching components between a low current transistor circuit and a high current transistor circuit.

17. The method of claim 15, further comprising:

waiting for a fourth trigger; and configuring the band-gap reference circuit for a fourth state based on the fourth trigger.

18. The method of claim 17, further comprising:

waiting for a fifth trigger; and configuring the band-gap reference circuit for the first state based on the fifth trigger.

19. The method of claim 18, configuring the band-gap reference circuit for the first state comprising switching a first transistor to the low current transistor circuit and switching a second transistor, a third transistor and a fourth transistor to the high current transistor circuit;

configuring the band-gap reference circuit for the second state comprising switching the second transistor to the low current transistor circuit and switching the first transistor to the high current transistor circuit;

configuring the band-gap reference circuit for the third state comprising switching the third transistor to the low current transistor circuit and switching the second transistor to the high current transistor circuit; and configuring the band-gap reference circuit for the fourth state comprising switching the fourth transistor to the low current transistor circuit and switching the third transistor to the high current transistor circuit.

20. The method of claim 15, further comprising generating a reference voltage using the band-gap reference circuit, wherein configuring the band-gap reference circuit for the different states at least partially reduces at least one of offset voltages and current mismatches in the band-gap reference circuit during generation of the reference voltage.

* * * * *